US008672190B1

(12) United States Patent
Wang

(10) Patent No.: US 8,672,190 B1
(45) Date of Patent: Mar. 18, 2014

(54) LOTION SPRAY HEAD ASSEMBLY

(71) Applicant: Ya-Tsan Wang, HsinChu (TW)

(72) Inventor: Ya-Tsan Wang, HsinChu (TW)

( * ) Notice: Subject to any disclaimer, the term of this patent is extended or adjusted under 35 U.S.C. 154(b) by 0 days.

(21) Appl. No.: 13/625,878

(22) Filed: Sep. 25, 2012

(51) Int. Cl.
*B67B 1/00* (2006.01)

(52) U.S. Cl.
USPC ..... 222/153.13; 222/321.9; 222/384

(58) Field of Classification Search
USPC ..... 222/153.13, 321, 321.1, 321.3, 222/321.7–321.9, 380, 384, 571; 239/337
See application file for complete search history.

(56) References Cited

U.S. PATENT DOCUMENTS 4,479,589 A * 10/1984 Ford ..... 222/153.13
4,524,888 A * 6/1985 Tada ..... 222/153.02
5,401,148 A * 3/1995 Foster et al. ..... 417/547
5,443,569 A * 8/1995 Uehira et al. ..... 222/190
5,570,819 A * 11/1996 Uehira et al. ..... 222/190
5,638,996 A * 6/1997 Montaner et al. ..... 222/321.2
5,720,419 A * 2/1998 Li ..... 222/321.2
5,738,250 A * 4/1998 Gillingham et al. ..... 222/153.13
5,806,721 A * 9/1998 Tada ..... 222/153.13
6,045,008 A * 4/2000 Gonzalez Fernandez et al. ..... 222/153.13
6,357,629 B1 * 3/2002 Ding ..... 222/153.13
6,604,656 B1 * 8/2003 Tseng ..... 222/153.13
7,147,133 B2 * 12/2006 Brouwer et al. ..... 222/145.5
8,028,861 B2 * 10/2011 Brouwer ..... 222/190
8,430,273 B2 * 4/2013 Brouwer ..... 222/190
2004/0056050 A1 * 3/2004 Nazari ..... 222/321.9
2007/0215642 A1 * 9/2007 van der Heijden ..... 222/190
2009/0039111 A1 * 2/2009 Tu ..... 222/190
2009/0255957 A1 * 10/2009 Mizushima et al. ..... 222/190
2012/0267399 A1 * 10/2012 Moretti ..... 222/321.2
2012/0305604 A1 * 12/2012 Wang ..... 222/321.9

* cited by examiner

*Primary Examiner* — Paul R Durand
*Assistant Examiner* — Randall Gruby

(57) ABSTRACT

A spray head assembly includes a press head, a seal member, a push tube, a piston unit, a resilient member, a cylinder unit, a valve and a mount. The press head has an annular face and a first locking portion. The seal member has an inner tube portion and a water-proof portion. The push tube is connected to the press head and has a second locking portion. The cylinder unit has a piston and a main rod respectively connected to the push tube. The main rod has a seal part and the cylinder unit has a narrowed portion. When the press head is pressed, the first locking portion and the second locking portion are positioned and the press head is easily assembled. The narrowed portion and the seal part, and the top of the inner tube portion and the annular face are engaged with each other to prevent from leakage.

8 Claims, 10 Drawing Sheets

LOTION SPRAY HEAD ASSEMBLY

BACKGROUND OF THE INVENTION (1) Field of the Invention

The present invention relates to a lotion spray head assembly, and more particularly, to an easily assembled, water-proof and sealed lotion spray head assembly.

(2) Description of the Prior Art

The conventional containers for receiving liquid such as lotion, cleaning agent, and water generally comprises a container and a spray head assembly which is connected to the container and the users get the liquid form the container by pressing the press head of the spray head assembly. However, there are some shortcomings to be improved.

FIG. 8 discloses a conventional spray head assembly 200 and the press head 201 is designed to be pressed toward the container 202 to get the liquid in the container 202 so as to avoid the liquid from ejecting out from the spray head assembly 200 by unintentional impact. When the press head 201 is in the pressed status, the passage 204 in the valve 203 of the spray head assembly 200 is opened. When the container 202 is tilted, the liquid in the container 202 leaks from the passage 204 or other gaps between the parts.

FIG. 9 discloses another conventional spray head assembly 200 which does not have water-proof design so that water may enter into the container via gaps to contaminate the liquid in the container.

FIG. 10 shows that the container 202 and the spray head assembly 200 are two separated parts, and the press head 201 is the final part to be assembled to the press tube 205 of the spray head assembly 200. However, the press tube 205 is not well positioned and the spring 206 is applied to the press tube 205 so that when the press head 201 is difficult to be assembled and the press head 201 is easily damaged during the assembling.

The present invention intends to provide a lotion spray head assembly, and more particularly, to an easily assembled, water-proof and sealed lotion spray head assembly.

SUMMARY OF THE INVENTION

The present invention relates to a spray head assembly and comprises a press head having a nozzle, a first connection portion and an extension portion which is located around the first connection portion. A reception area is defined between the first connection portion and the extension portion. An annular face is defined in the inner periphery of the reception area. A seal member is a hollow part and has an inner tube portion and a water-proof portion. The inner tube portion is inserted into the reception area and the top of the inner tube portion is engaged with the annular face to form a seal status. The inner tube portion has a first locking portion located therein and the water-proof portion is located on outside of the inner tube portion. The inner wall of the water-proof portion is higher than the outer periphery of the seal member.

A push tube is a hollow tube and extends through the seal member. The push tube has a first tube, a second tube and an engaging portion. The first tube has a second connection portion and a second locking portion. The push tube is connected to the press head by connecting the second connection portion to the first connection portion. The second locking portion is connected to the first locking portion.

A piston unit has a piston and a main rod. The piston is a hollow part and mounted to the second tube. The piston has an annular portion on one end thereof. The contact portion movably contacts the annular portion so as to define an outlet between the annular portion and the contact portion. The main rod has multiple axial grooves defined in the outside thereof and a seal part is connected to the lower end of the main rod.

A resilient member is mounted to the push tube and one end of the resilient member contacts the underside of the inner tube portion.

A cylinder unit is connected to the seal member and a mount is located between the seal member and the cylinder unit. The cylinder unit has a first cylinder, a second cylinder and a narrowed portion. The piston is movably inserted in the first cylinder and defines a chamber in the first cylinder.

The narrowed portion is located between the first and second cylinders. The narrowed portion is engaged with the seal part to form a sealed status.

A valve contacts an inlet of the second cylinder.

Furthermore, the extension portion has an air hole to communicate the interior of the spray head assembly and the outside to prevent from sucking water of the water-proof portion.

The water-proof portion is located on outside of the inner tube portion so that water can keep water therein. The inner wall of the water-proof portion is higher than the outer periphery of the seal member, and the air hole communicates the interior or the spray head assembly the outside so as to prevent the water in the water-proof portion from being entering into the container to contaminate the liquid in the container.

When the press head is pressed, the first locking portion and the second locking portion are positioned so that the press head is easily assembled.

The narrowed portion and the seal part are engaged with each other, and the top of the inner tube portion and the annular face are engaged with each other to prevent from leakage when the container is tilt.

The resilient member is mounted to the outside of the press tube and the liquid passes through the interior of the press tube. The valve is a resilient spiral plastic (non-metallic) member to avoid the liquid from being in contact with metal material so that the liquid is not contaminated by the resilient member and the valve.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
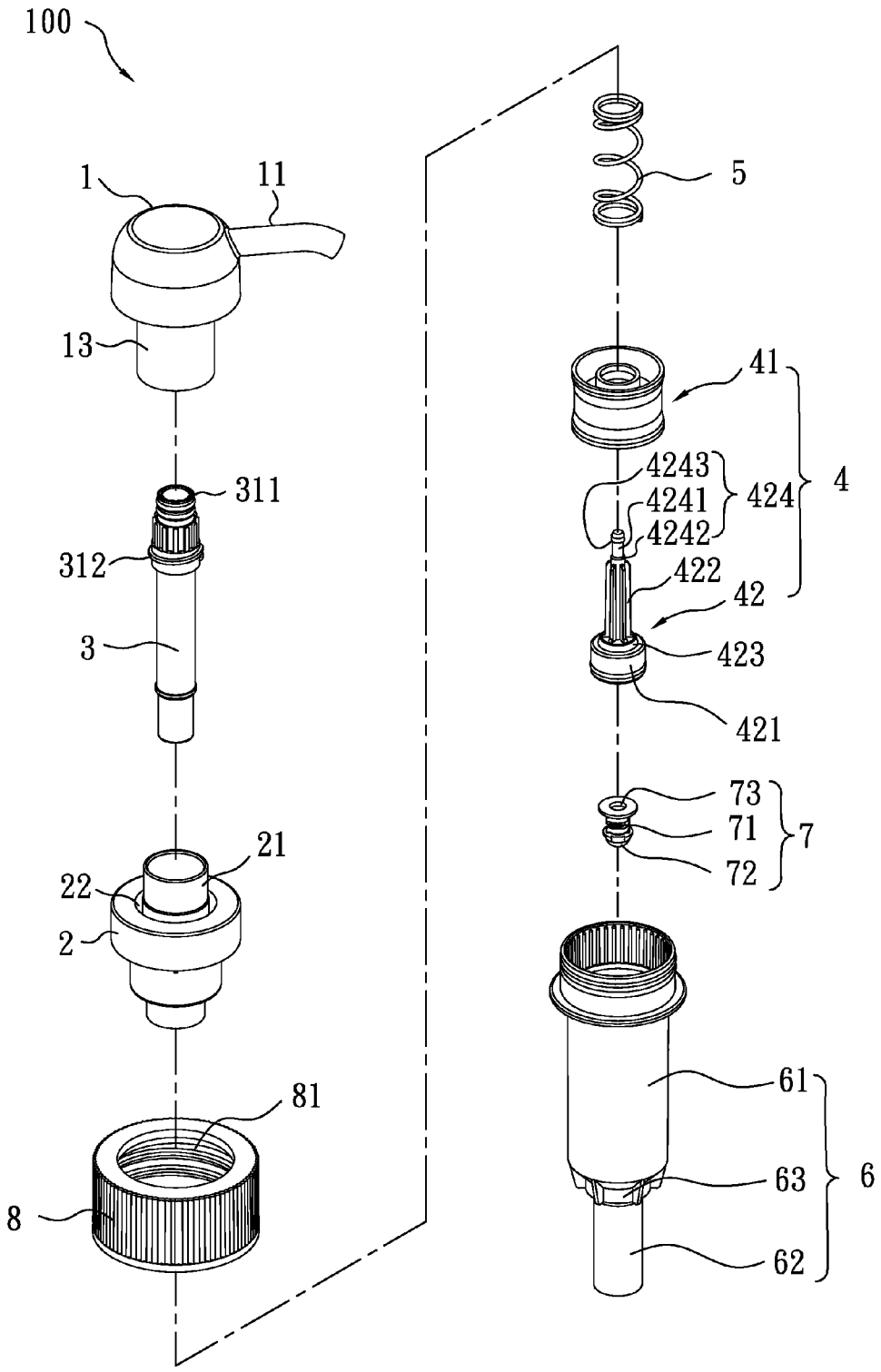
FIG. 1 is an exploded view to show the spray head assembly of the present invention.
Figure 2:
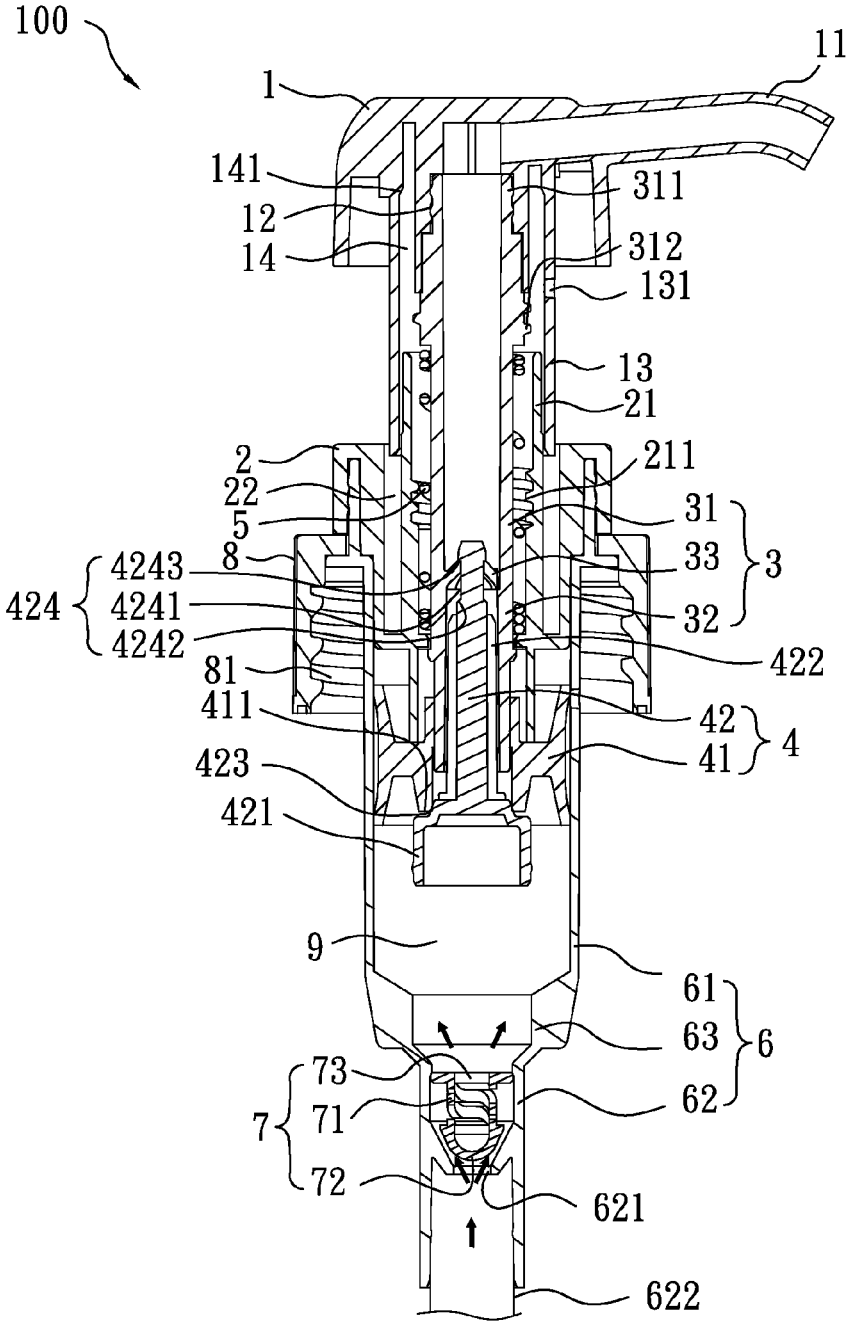
FIG. 2 is a cross sectional view of the spray head assembly of the present invention.

Referring to FIGS. 1 and 2, the spray head assembly 100 of the present invention comprises a press head 1, a seal member 2, a push tube 3, a piston unit 4, a resilient member 5, a cylinder unit 6, a valve 7 and a mount 8.

The press head 1 has a nozzle 11, a first connection portion 12 and an extension portion 13 which is located around the first connection portion 12 and extends downward. A reception area 14 is defined between the first connection portion 12 and the extension portion 13. An annular face 141 is defined in the inner periphery of the reception area 14. Lotion is ejected from the nozzle 11.

The seal member 2 is a hollow part and has an inner tube portion 21 and a water-proof portion 22. The inner tube portion 21 is inserted into the reception area 14 and the top of the inner tube portion 21 is engaged with the annular face 141 to form a seal status. The inner tube portion 21 has a first locking portion 211 located therein and the water-proof portion 22 is located on outside of the inner tube portion 21. The water-proof portion 22 is a recess so as to retain water therein. The inner wall of the water-proof portion 22 is higher than the outer periphery of the seal member 2 so as to prevent the water from entering into the spray head assembly 100.

The push tube 3 is a hollow tube and extends through the inner tube portion 21 of the seal member 2. The push tube 3 has a first tube 31, a second tube 32 and an engaging portion 33. The first tube 31 has a second connection portion 311 and a second locking portion 312. The push tube 3 is connected to the press head 1 by connecting the second connection portion 311 to the first connection portion 12. The second locking portion 312 is connected to the first locking portion 211.

Figure 3:
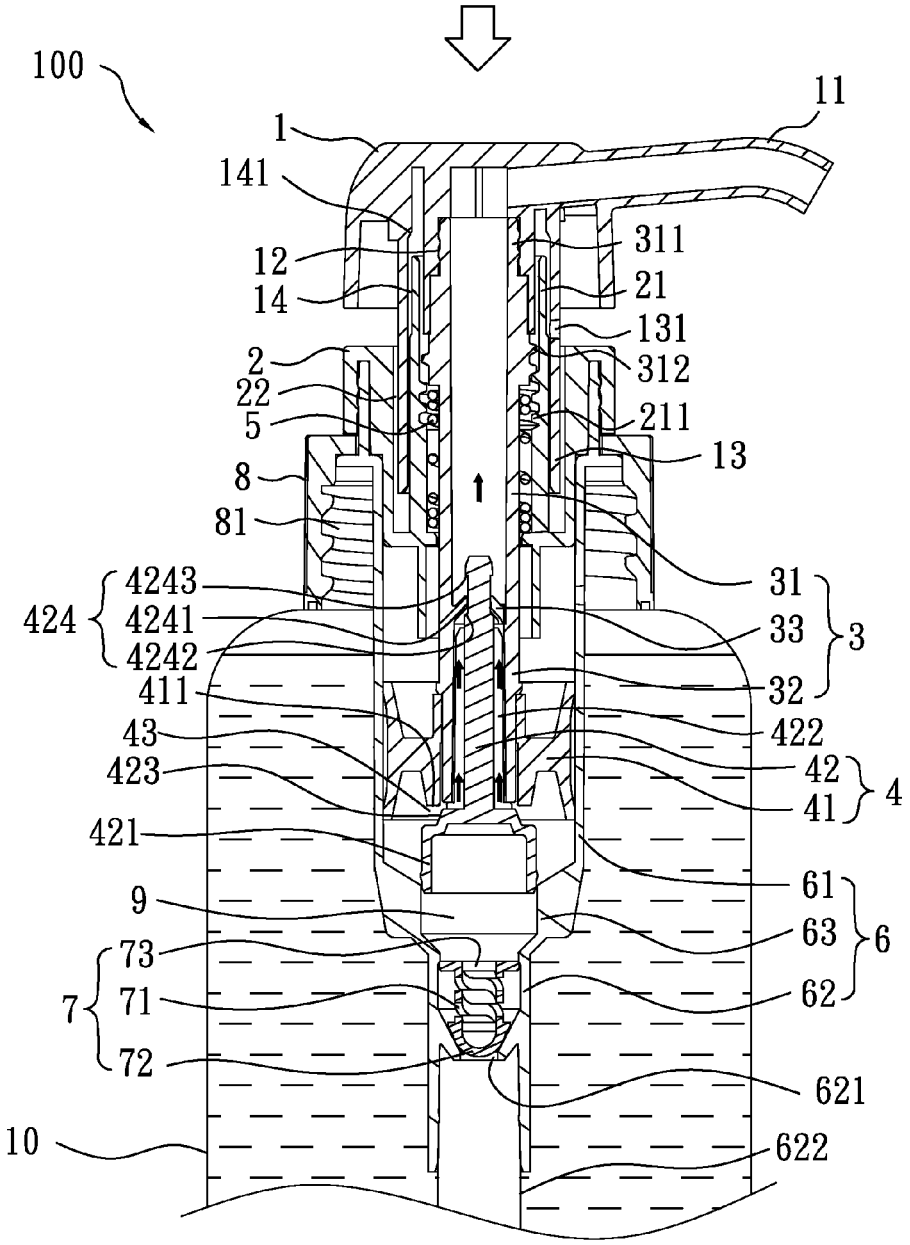
FIG. 3 is a cross sectional view of the spray head assembly of the present invention, wherein the press head is pressed.

The piston unit 4 has a piston 41 and a main rod 42. The piston 41 is a hollow part and mounted to the second tube 32. The piston 41 further has an annular portion 411 on one end thereof. The main rod 42 extends through the second tube 32 and the engaging portion 33 is connected to the second tube 32. The contact portion 423 movably contacts the annular portion 411 so as to define an outlet 43 between the annular portion 411 and the contact portion 423 as shown in FIG. 3. The main rod 42 has multiple axial grooves 422 defined in the outside thereof and a seal part 421 is connected to the lower end of the main rod 42.

The resilient member 5 is mounted to the push tube 3 and one end of the resilient member 5 contacts the underside of the inner tube portion 21. The other end of the resilient member 5 contacts the top of the inner tube portion 21.

The cylinder unit 6 is connected to the seal member 2 and the mount 8 is located between the seal member 2 and the cylinder unit 6. The cylinder unit 6 has a first cylinder 61, a second cylinder 62 and a narrowed portion 63. In this embodiment, the first cylinder 61 is larger than the second cylinder 62 and the piston 41 is movably inserted in the first cylinder 61 and defines a chamber 9 in the first cylinder 61. The narrowed portion 63 is located between the first and second cylinders 61, 62. The narrowed portion 63 is engaged with the seal part 421 to form a sealed status. The mount 8 has threads 81 defined in the inner periphery thereof so as to be connected with a container 10.

The valve 7 contacts the inlet 621 of the second cylinder 62 and the inlet 621 of the cylinder unit 6 is connected with a hose 622 so as to suck the liquid in the container 10 as shown in FIG. 3. In this embodiment, the valve 7 is a threaded part and opens or closes the inlet 621 by moving upward or downward.

The extension portion 13 has an air hole 131 to communicate with the outside of the lotion spray head assembly 100 to prevent from sucking the water in the water-proof portion 22.

The valve 7 has a resilient and spiral portion 71 which has a stop 72 which faces the inlet 621. The stop 72 contacts the inlet 621. The resilient and spiral portion 71 has a passage 73 which faces the second cylinder 62 so that the liquid can flow into the chamber 9 via the passage 73.

Furthermore, the main rod 42 has an elongate end 424 which is slidably engaged with to the engaging portion 33. A slide 4241 is defined in the elongate portion 33 and the slide 4241 has an initial positioning point 4242 and a final positioning point 4243. The engaging portion 33 slides from the initial positioning point 4242 to the final positioning point 4243 to complete a suction-back action.

The resilient member 5 is mounted to the outside of the press tube 3 and the liquid passes through the interior of the press tube 3. The valve 7 is a resilient spiral plastic (non-metallic) member to avoid the liquid from being in contact with metal material so that the liquid is not contaminated by the resilient member 5 and the valve 7.

As shown in FIG. 3, when the press head 1 is pressed downward, the press tube 3 and the main rod 42 are moved downward, the piston 41 is stationary because of the friction with the inner periphery of the first cylinder 61, so that the valve 7 is moved downward to seal the inlet 621. Therefore, the outlet 43 between the annular portion 411 and the contact portion 423 is gradually opened, so that the liquid in the chamber 9 flows to the axial grooves 422 via the outlet 43, and is ejected from the nozzle 11 via the push tube 3.

When the press head 1 is released, the press tube 3 moves upward and the main rod 42 is not moved with the press tube 3. When the engaging portion 33 of the press tube 3 slides from the initial positioning point 4242 to the final positioning point 4243 and is positioned, the press tube 3 the main rod 42 are moved upward by the resilient member 5, the piston 41 is stationary because of the friction with the inner periphery of the first cylinder 61. Therefore, the outlet 43 between the annular portion 411 and the contact portion 423 is gradually closed. Along with the upward movement of the push rube 3 and the main rod 42, the volume of the chamber 9 gradually increased. The liquid in the container 10 pushes the valve 7 to gradually open the inlet 621, so that the liquid in the container 10 enters into the chamber 9 via the valve 7 and ready for the next pump as shown in FIG. 2.

Figure 4:
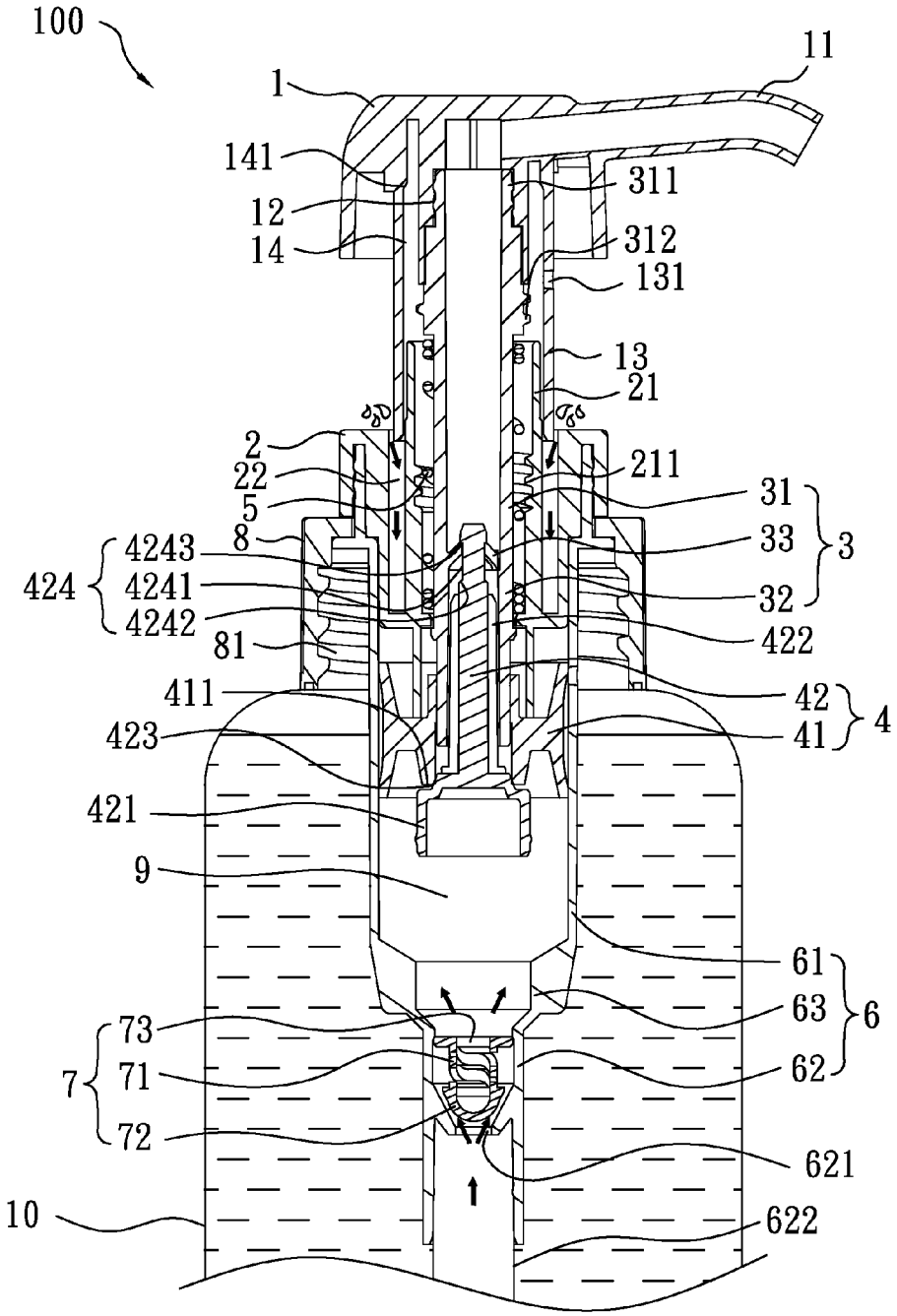
FIG. 4 shows the water-proof feature of the spray head assembly of the present invention.

As shown in FIG. 4, when water is splashed to the lotion spray head assembly 100, the water is retained in the water-proof portion 22 which is a recess in this embodiment. Because the inner wall of the water-proof portion 22 is higher than the outer periphery of the seal member 2 so that the inner tube portion 21 and the push tube 3 are located in the extension portion 13 of the press head 1, and the extension portion 13 has the air hole 131 to communicate with the outside of the lotion spray head assembly 100 so as to prevent from sucking the water in the water-proof portion 22. The liquid in the container 10 is not contaminated.

Figure 5:
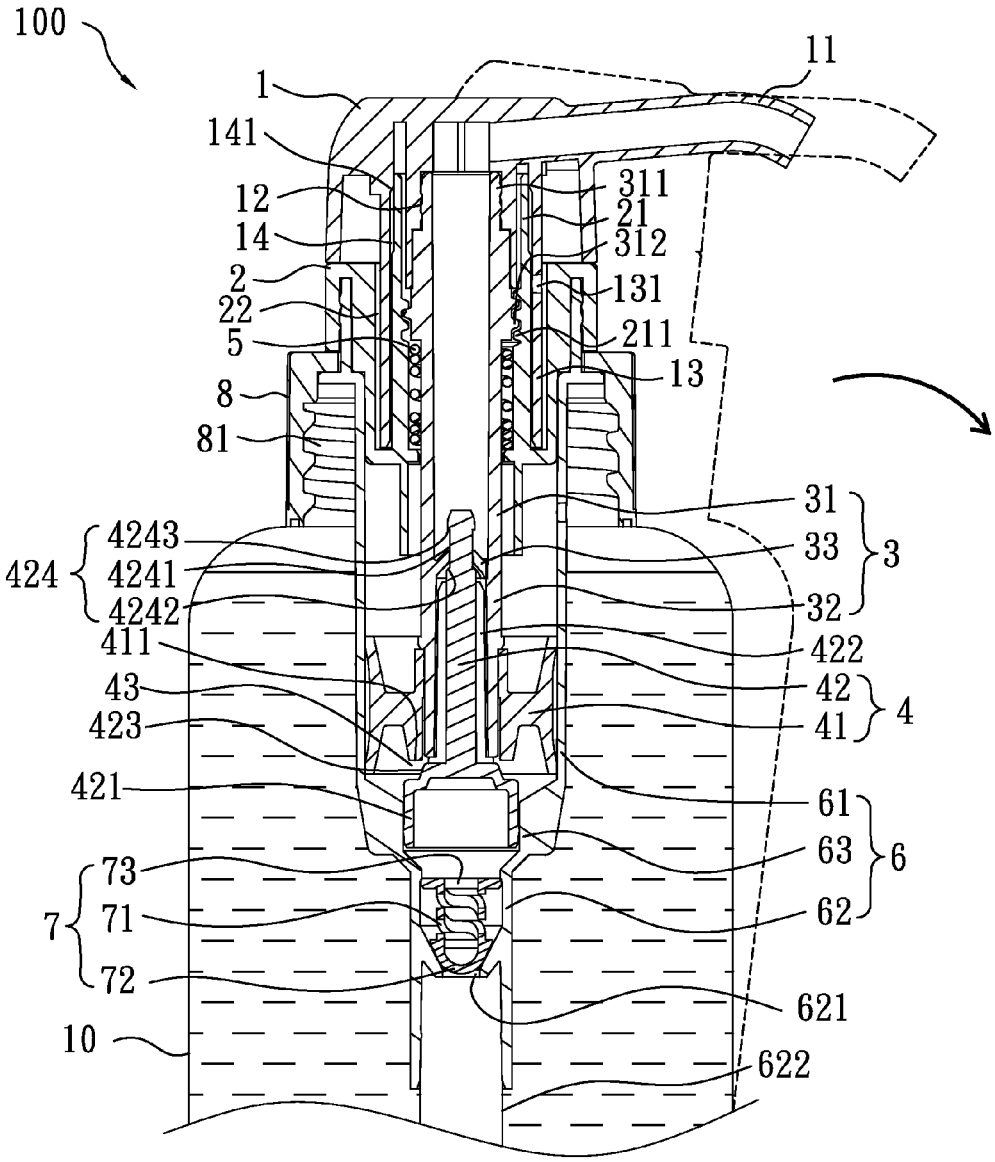
FIG. 5 shows the leakage-proof feature of the spray head assembly of the present invention.

As shown in FIG. 5, when the press head 1 is pressed and rotated, the first and second locking portion 312, 211 are connected to each other, and the narrowed portion 63 and the seal part 421 are engaged with each other to form a sealed status. The top of the inner tube portion 21 is in contact with the annular face 141 to seal the air hole 131 to form a sealed status. When the container 10 is tilted, the liquid in the container 10 does not flow out because the spray head assembly is sealed.

Figure 6:
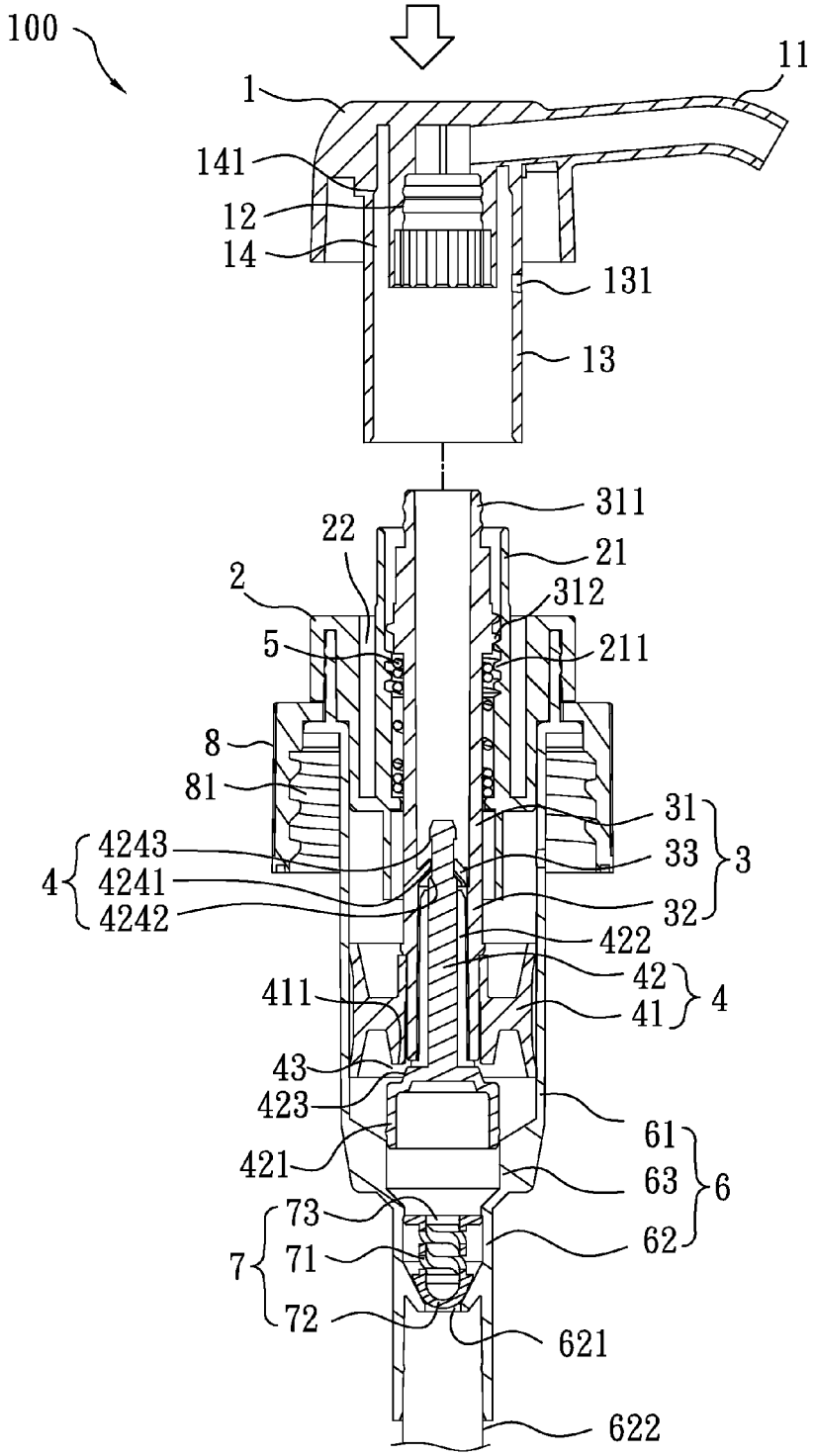
FIG. 6 shows that the press head is easily assembled.

As shown in FIG. 6, when assembling the press head 1, the press head 1 is pushed downward, the first and second locking portion 211, 312 are in contact with each other, so that the push tube 3 is stable and the press head 1 is easily assembled.

Figure 7:
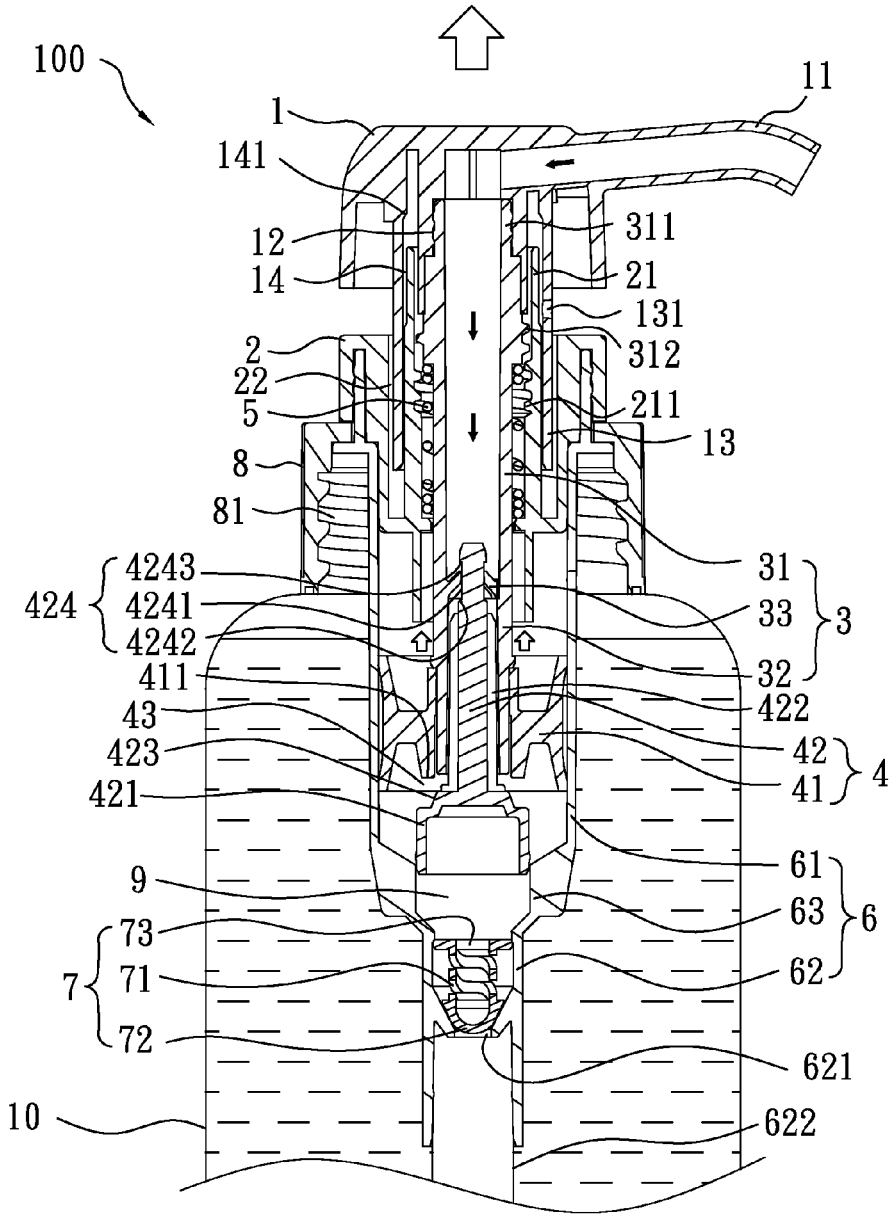
FIG. 7 shows the suction-back action of the spray head assembly of the present invention.
Figure 8:
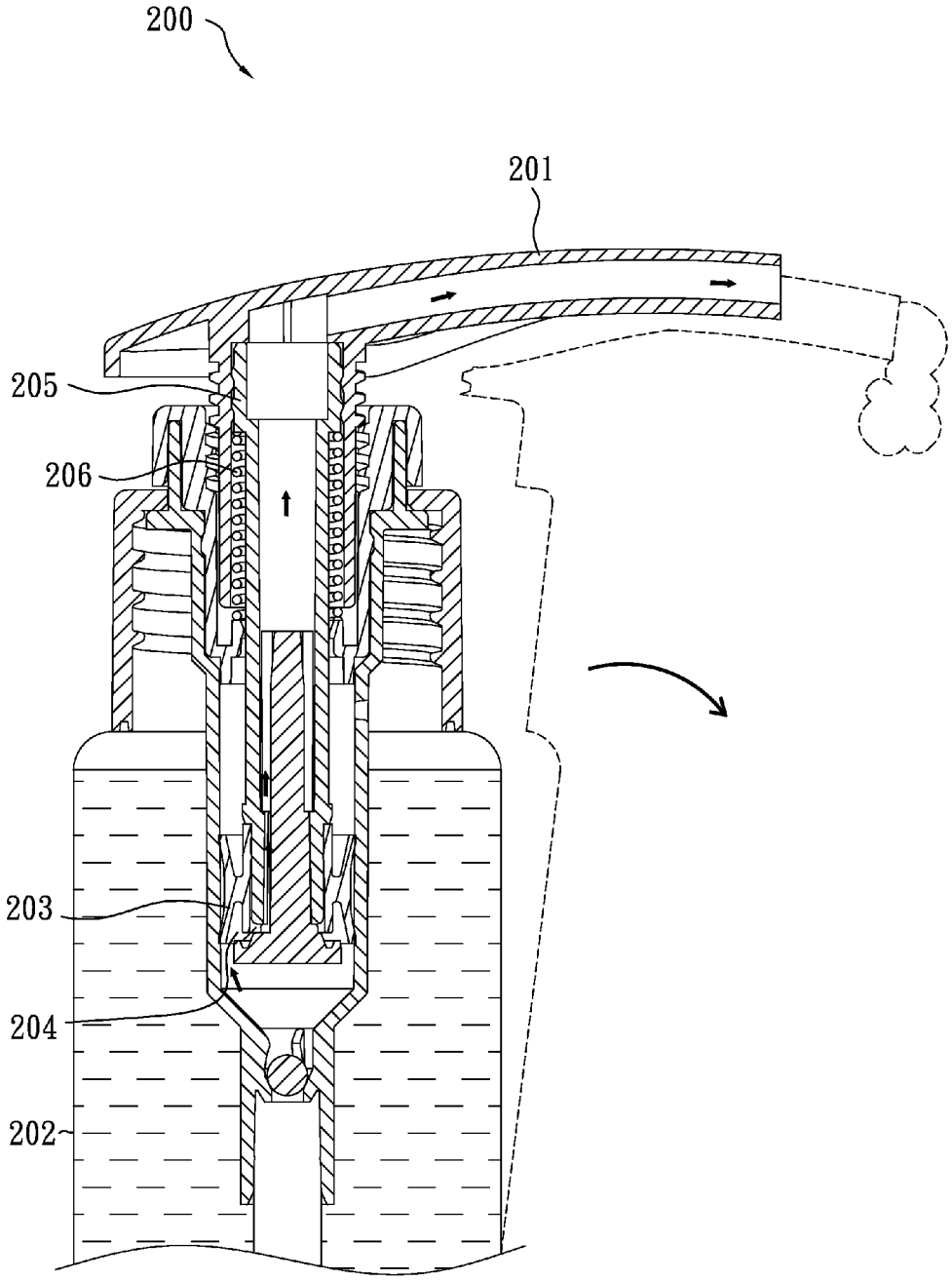
FIG.8 PRIOR ART
FIG. 8 shows the leakage of the conventional spray head assembly
Figure 9:
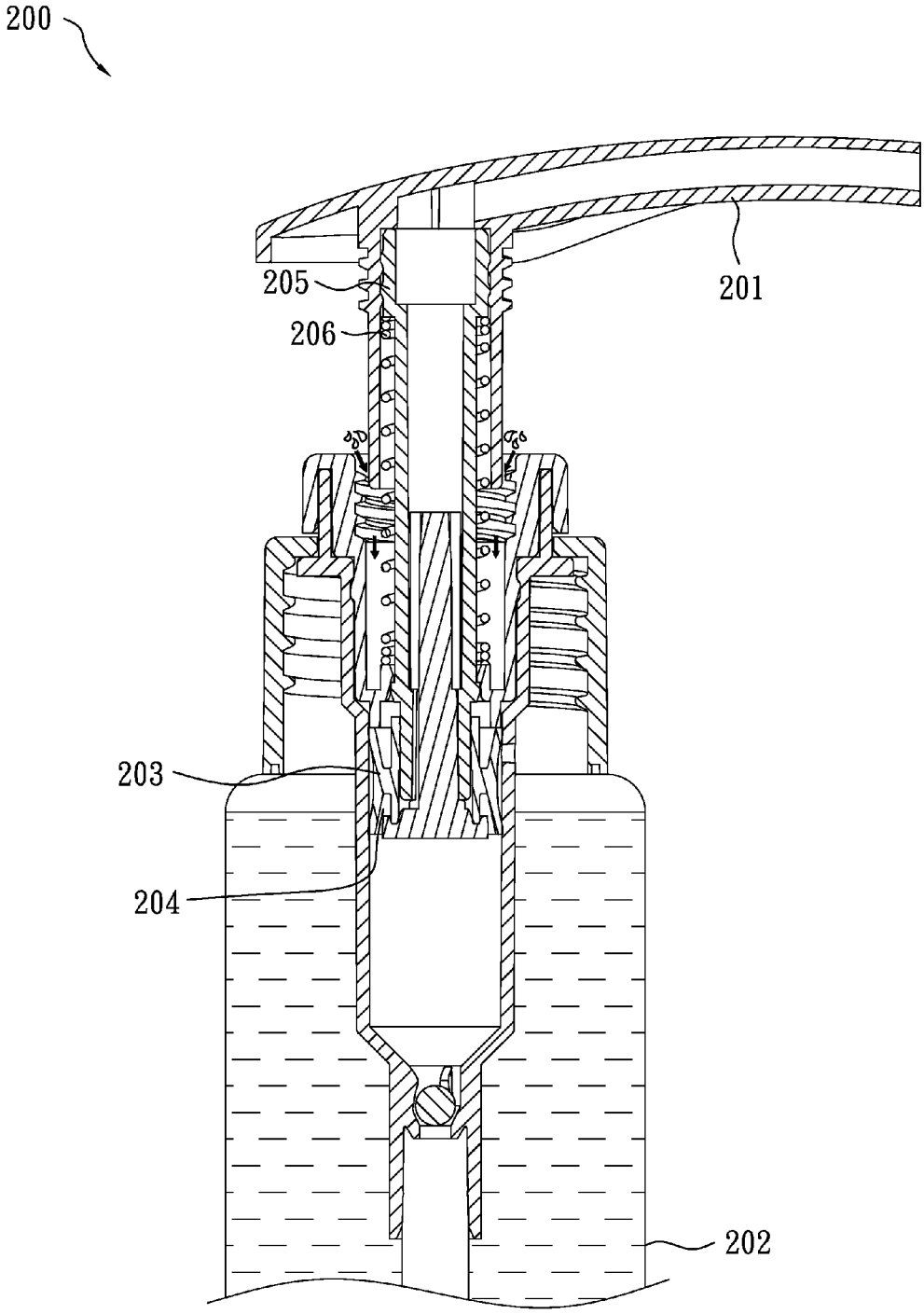
FIG.9 PRIOR ART
FIG. 9 shows that the conventional spray head assembly is not water-proof.
Figure 10:
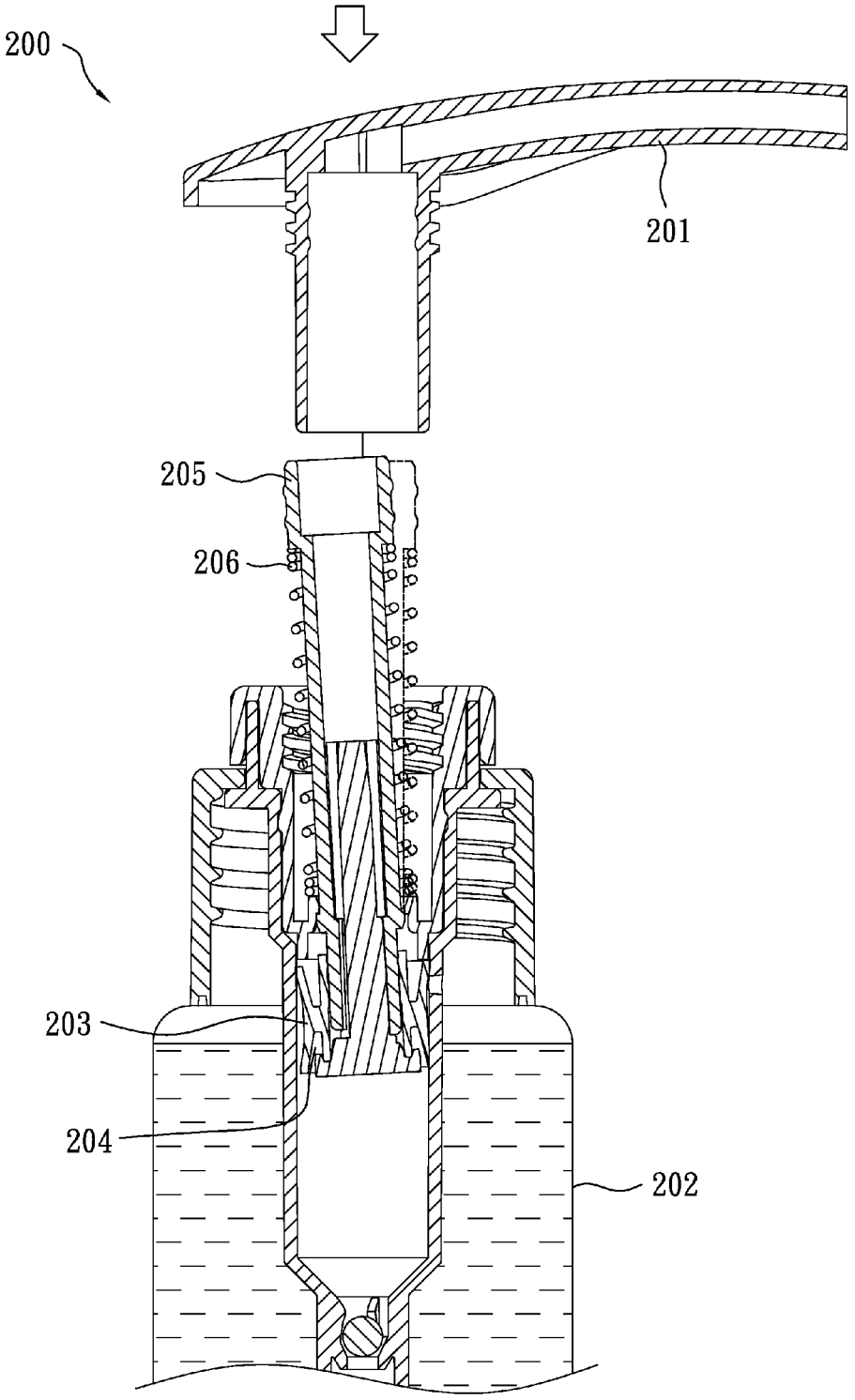
FIG.10 PRIOR ART
FIG. 10 shows that the press head of the conventional spray head assembly is difficult to be assembled.

FIG. 7 shows the suction-back action of the spray head assembly 100 of the present invention, when the press head 1 is released, due to the suction-back action, the press tube 3 moves upward while the main rod 42 is temporarily not moved and the difference of pressure in the press tube 3 increases suddenly so that the liquid remained in the press tube 3 is sucked back due to the difference of pressure to prevent the liquid remained in the nozzle 11 flows out by the gravity.

While we have shown and described the embodiment in accordance with the present invention, it should be clear to those skilled in the art that further embodiments may be made without departing from the scope of the present invention.

What is claimed is:

1. A spray head assembly comprising:

a press head having a nozzle, a first connection portion and an extension portion which is located around the first connection portion, a reception area defined between the first connection portion and the extension portion, an annular face defined in an inner periphery of the reception area;

a seal member being a hollow part and having an inner tube portion and a water-proof portion, the inner tube portion inserted into the reception area and a top of the inner tube portion being engaged with the annular face to form a seal status, the inner tube portion having a first locking portion located therein and the water-proof portion located on outside of the inner tube portion, an inner wall of the water-proof portion being higher than an outer periphery of the seal member;

a push tube being a hollow tube and extending through the seal member, the push tube having a first tube, a second tube and an engaging portion, the first tube having a second connection portion and a second locking portion, the push tube connected to the press head by connecting the second connection portion to the first connection portion, the second locking portion connected to the first locking portion;

a piston unit having a piston and a main rod, the piston being a hollow part and mounted to the second tube, the piston having an annular portion on an end thereof, a contact portion of the main rod movably contacting the annular portion so as to define an outlet between the annular portion and the contact portion, the main rod having multiple axial grooves defined in an outside thereof and a seal part connected to a lower end of the main rod;

a resilient member mounted to the push tube and an end of the resilient member contacting an underside of the inner tube portion;

a cylinder unit connected to the seal member and a mount located between the seal member and the cylinder unit, the cylinder unit having a first cylinder, a second cylinder and a narrowed portion, the piston movably inserted in the first cylinder and defining a chamber in the first cylinder;

the narrowed portion located between the first and second cylinders, the narrowed portion engaged with the seal part to form a sealed status, and a valve contacting an inlet of the second cylinder.

2. The assembly claimed in claim 1, wherein the valve is a threaded part and opens or closes the inlet by moving upward or downward.

3. The assembly as claimed in claim 1, wherein the mount has threads defined in an inner periphery thereof for being connected with a container.

4. The assembly as claimed in claim 1, wherein the inlet of the cylinder unit is connected with a hose.

5. The assembly as claimed in claim 1, wherein the valve has a resilient and spiral portion which has a stop which faces the inlet, the stop contacts the inlet, the threaded portion has a passage which faces the second cylinder.

6. The assembly as claimed in claim 1, wherein the water-proof portion is a recess.

7. The assembly as claimed in claim 1, wherein the extension portion has an air hole.

8. The assembly as claimed in claim 1, wherein the main rod has an elongate end which is slidably engaged with the engaging portion, a slide is defined in the elongate portion and has an initial positioning point and a final positioning point.

* * * * *